US009325088B2

(12) United States Patent
Yagi et al.

(10) Patent No.: US 9,325,088 B2
(45) Date of Patent: Apr. 26, 2016

(54) LEG UNIT WITH PROJECTIONS WITH ARCUATE OUTER SURFACES FOR ENGAGING A FIXING HOLE IN A PRINTED CIRCUIT BOARD

(71) Applicant: DAI-ICHI SEIKO CO., LTD., Kyoto (JP)

(72) Inventors: Sakai Yagi, Shizuoka (JP); Jun Mukunoki, Shizuoka (JP)

(73) Assignee: DAI-ICHI SEIKO CO., LTD (JP)

( * ) Notice: Subject to any disclaimer, the term of this patent is extended or adjusted under 35 U.S.C. 154(b) by 0 days.

(21) Appl. No.: 14/517,035

(22) Filed: Oct. 17, 2014

(65) Prior Publication Data

US 2015/0118871 A1 Apr. 30, 2015

(30) Foreign Application Priority Data

Oct. 30, 2013 (JP) ..... 2013-225790

(51) Int. Cl.

| | |
|---|---|
| ***H01R 13/60*** | (2006.01) |
| ***H01R 12/52*** | (2011.01) |
| ***H01R 12/50*** | (2011.01) |
| ***H01R 12/58*** | (2011.01) |
| ***H01R 12/73*** | (2011.01) |

(52) U.S. Cl.

CPC ..... *H01R 12/523* (2013.01); *H01R 12/585* (2013.01); *H01R 12/73* (2013.01); *H01R 23/7021* (2013.01)

(58) Field of Classification Search

CPC ..... H01R 12/523; H01R 13/60; H01R 13/64; H01R 13/66; H01R 23/701; H01R 23/7015; H01R 23/7025; H01R 23/7057; H01R 23/7021

USPC ..... 439/65, 378, 567

See application file for complete search history.

(56) References Cited

U.S. PATENT DOCUMENTS

| | | | | | |
|---|---|---|---|---|---|
| 5,437,561 | A * | 8/1995 | Earl et al. | ..... | 439/567 |
| 5,613,877 | A * | 3/1997 | Patel et al. | ..... | 439/567 |
| 5,980,314 | A * | 11/1999 | Roberts | ..... | 439/567 |
| 6,109,961 | A * | 8/2000 | Chen et al. | ..... | 439/567 |
| 6,257,925 | B1 * | 7/2001 | Jones | ..... | 439/557 |
| 6,572,404 | B1 * | 6/2003 | Wu | ..... | 439/567 |
| 7,500,872 | B2 * | 3/2009 | Takahashi et al. | ..... | 439/567 |
| 2004/0053529 | A1 * | 3/2004 | Kato et al. | ..... | 439/567 |

FOREIGN PATENT DOCUMENTS

| | | |
|---|---|---|
| JP | 54-94885 | 12/1952 |
| JP | 56-11479 | 7/1954 |

(Continued)

*Primary Examiner* — Chandrika Prasad

(74) *Attorney, Agent, or Firm* — Hayes Soloway P.C.

(57) ABSTRACT

A leg unit used for a connector housing, the leg unit being inserted into a fixing hole formed through a printed circuit board from a first surface towards a second surface of the printed circuit board, the leg unit including a first projection having elasticity, a second projection, and a contact portion making contact with the first surface when the leg unit is inserted into the fixing hole, the first and second projections being spaced away from each other and facing each other, a distance between an outer surface of the first projection and an outer surface of the second projection being greater within a predetermined range than an inner diameter of the fixing hole, the first projection including a unit for preventing the leg unit from being released out of the fixing hole after the leg unit has been inserted into the fixing hole.

9 Claims, 23 Drawing Sheets

(56) References Cited

FOREIGN PATENT DOCUMENTS

| | | | |
|---|---|---|---|
| JP | 4-49472 | 4/1992 | H01R 9/09 |
| JP | 4-106882 | 9/1992 | H01R 23/68 |
| JP | 10-255931 | 9/1998 | H01R 23/68 |
| JP | 11-040286 | 2/1999 | H01R 23/68 |
| JP | 2002-184510 | 6/2002 | H01R 13/46 |
| JP | 2002-319443 | 10/2002 | H01R 12/22 |
| JP | 2012-256477 | 12/2012 | H01R 12/51 |

* cited by examiner

LEG UNIT WITH PROJECTIONS WITH ARCUATE OUTER SURFACES FOR ENGAGING A FIXING HOLE IN A PRINTED CIRCUIT BOARD

BACKGROUND OF THE INVENTION

1. Field of the Invention

The invention relates to a leg unit equipped in a housing of an electric connector, and further, to a connector housing including the leg unit.

2. Description of the Related Art

An electric connector mounted on a printed circuit board is connected, for instance, directly to another printed circuit board, to another electric connector mounted on another printed circuit board, or to a cable. For fixing an electric connector onto a printed circuit board, a leg unit formed on a housing of the electric connector is inserted into a fixing hole formed through the printed circuit board, and the leg unit is engaged at a distal end thereof to a circumferential edge of the fixing hole.

As one of such electric connectors, Japanese Patent Application Publication No. 2002-319443 has suggested an electric connector 1000, which is illustrated in FIG. 26.

The illustrated electric connector 1000 includes a housing 1001. The housing 1001 includes at opposite ends thereof a pair of contact surfaces 1002 making contact with an upper surface 1003 of a printed circuit board 1101, and a pair of engagement units 1003 in the form of a boss and formed of resin integrally with the housing 1001. The engagement unit 1003 is inserted into a fixing hole 1102 from the upper surface 1103 to a lower surface 1104, and is engaged to the lower surface 1104. The engagement unit 1003 is in the form of a boss, specifically, a substantially cylindrical projection, and is comprised of a pair of halves 1005 and 1006 formed by dividing a cylinder into two semicircular halves with a gap 1004. The half 1005 located nearer to an end of the electric connector 1000 than the half 1006 is designed at a distal end thereof with an outwardly directing hook 1007, through which the engagement unit 1003 is engaged to a circumferential edge of the fixing hole 1102.

The electric connector 1000 illustrated in FIG. 26 is accompanied with a problem that since there is a gap between an outer surface of the engagement unit 1003 and an inner surface of the fixing hole 1102, there is generated looseness in the housing 1001 in a direction in which the engagement unit 1003 is inserted into and released out of the fixing hole 1102 (that is, a thickness-wise direction of the printed circuit board 1101) and/or in a direction of a plane of the printed circuit board 1101.

The looseness generated in the housing 1001 may cause to exert a load onto a connector terminal connected to the printed circuit board 1101.

SUMMARY OF THE INVENTION

In view of the above-mentioned problem in the conventional electric connector, it is an object of the present invention to provide a leg unit used for a connector housing, enabling a connector housing to follow a displacement of a printed circuit board in a thickness-wise direction of a printed circuit board and/or in a direction of a plane of a printed circuit board to thereby prevent generation of looseness between a printed circuit board and a connector housing, ensuring reduction in a load to be exerted onto a connector terminal.

In one aspect of the present invention, there is a leg unit used for a connector housing, the leg unit being inserted into a fixing hole formed through a printed circuit board from a first surface towards a second surface of the printed circuit board, the leg unit including a first projection having elasticity, a second projection, and a contact portion making contact with the first surface when the leg unit is inserted into the fixing hole, the first and second projections being spaced away from each other and facing each other, a distance between an outer surface of the first projection and an outer surface of the second projection being greater within a predetermined range than an inner diameter of the fixing hole, the first projection including a structure for preventing the leg unit from being released out of the fixing hole after the leg unit has been inserted into the fixing hole.

In the above-mentioned leg unit, the contact portion prevents forward movement of the first and second projections after the leg unit was inserted into a fixing hole of a printed circuit board and the first projection makes contact with an inner surface of a fixing hole by virtue of elastic reaction force to thereby prevent backward movement of the first and second projections, ensuring that a connector housing in which the leg unit is equipped is capable of following a displacement of a printed circuit board in a thickness-wise direction thereof (that is, a direction in which the leg unit is inserted into and released out of a fixing hole). Furthermore, the second projection makes contact at an outer surface thereof with an inner surface of a fixing hole to thereby position a connector housing relative to a printed circuit board, ensuring that a connector housing in which the leg unit is equipped is capable of following a displacement of a printed circuit board in a direction of a plane of the printed circuit board.

It is preferable that the predetermined range is defined as such a range that the first projection is kept inclined in the fixing hole, and the first projection makes contact with an edge of the fixing hole on a level with the first surface when the leg unit is inserted into the fixing hole.

For instance, the predetermined range is defined as a range of 0.5% to 20% of an inner diameter of the fixing hole.

It is preferable that the first projection includes a first shaft portion, a second shaft portion outwardly extending relative to the first shaft portion, and an inclined portion formed between the first and second shaft portions, the inclined portion making contact with an edge of the fixing hole on a level with the second surface when the leg unit is inserted into the fixing hole, the inclined portion defining the structure.

The inclined portion makes contact with an edge of the fixing hole on a level with the second surface when the leg unit is inserted into the fixing hole, and thus, the leg unit is prevented from being released out of the fixing hole. Thus, the first projection is elastically deformed in response to a displacement of a printed circuit board in a thickness-wise direction thereof, and the inclined portion is kept engaged to an edge of the fixing hole to thereby absorb the displacement. Accordingly, it is possible to prevent looseness of the first projection relative to the fixing hole.

It is preferable that the first projection includes a first shaft portion, and a second shaft portion outwardly extending relative to the first shaft portion, a wall extending perpendicularly to a length-wise direction of the first projection between the first and second shaft portions, the wall making contact with the second surface when the leg unit is inserted into the fixing hole, the wall defining the structure.

The wall makes contact with the second surface after the leg unit was inserted into the fixing hole, and thus, the leg unit is prevented from being released out of the fixing hole. Thus, the first projection is elastically deformed in response to a displacement of a printed circuit board in a thickness-wise direction thereof, and the wall is kept engaged to the second surface of a printed circuit board to thereby absorb the displacement. Accordingly, it is possible to prevent looseness of the first projection relative to the fixing hole.

It is preferable that the contact portion includes a surface making contact with the first surface when the leg unit is inserted into the fixing hole.

It is preferable that the contact portion has elasticity.

The contact portion makes contact with the first surface of a printed circuit board and pushes the same upwardly, the first shaft portion of the first projection makes contact with an edge of the fixing hole on a level with the first surface of a printed circuit board, and the inclined portion of the first projection is engaged to an edge of the fixing hole on a level with the second surface of a printed circuit board, ensuring that the first projection is firmly engaged to a printed circuit board, and accordingly, looseness of the first projection relative to the fixing hole can be prevented.

It is preferable that each of the first and second projections has a semicircular cross-section, the first and second projections being arranged such that arcuate portions thereof face in opposite directions.

It is preferable that the second projection has an arcuate cross-section having a circumference angle equal to or greater than 180 degrees.

It is preferable that the first projection is comprised of a plurality of projections having the same configuration as one another.

In another aspect of the present invention, there is provided a connector housing used for an electric connector, the housing including the above-mentioned leg unit by one or more.

The advantages obtained by the aforementioned present invention will be described hereinbelow.

In the leg unit in accordance with the present invention, the first projection is flexibly elastically deformed to thereby enable a connector housing to follow by virtue of elastic reaction force thereof a displacement of a printed circuit board not only in a thickness-wise direction of the same, but also in a direction of a plane of a printed circuit board. Accordingly, the leg unit makes it possible to prevent looseness of a connector housing relative to a printed circuit board, and further, to reduce a load to be exerted onto connector terminals supported by the connector housing.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS (First Embodiment)

A leg unit 50 in accordance with the first embodiment of the present invention is explained hereinbelow with reference to the drawings.

Figure 1:
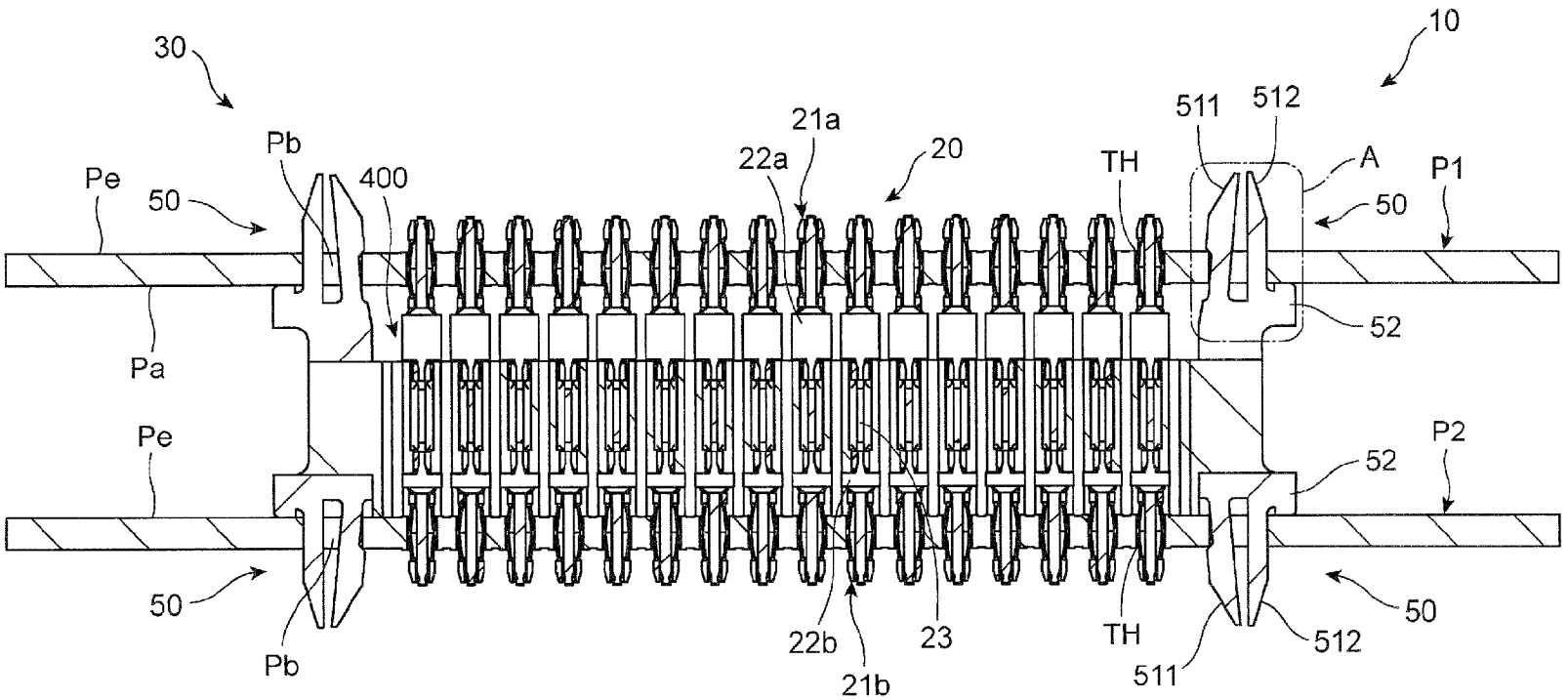
FIG. 1 is a cross-sectional view of printed circuit boards, connector terminals sandwiched therebetween, and a connector housing supporting the connector terminals, and including the leg unit in accordance with the first embodiment of the present invention.
Figure 2:
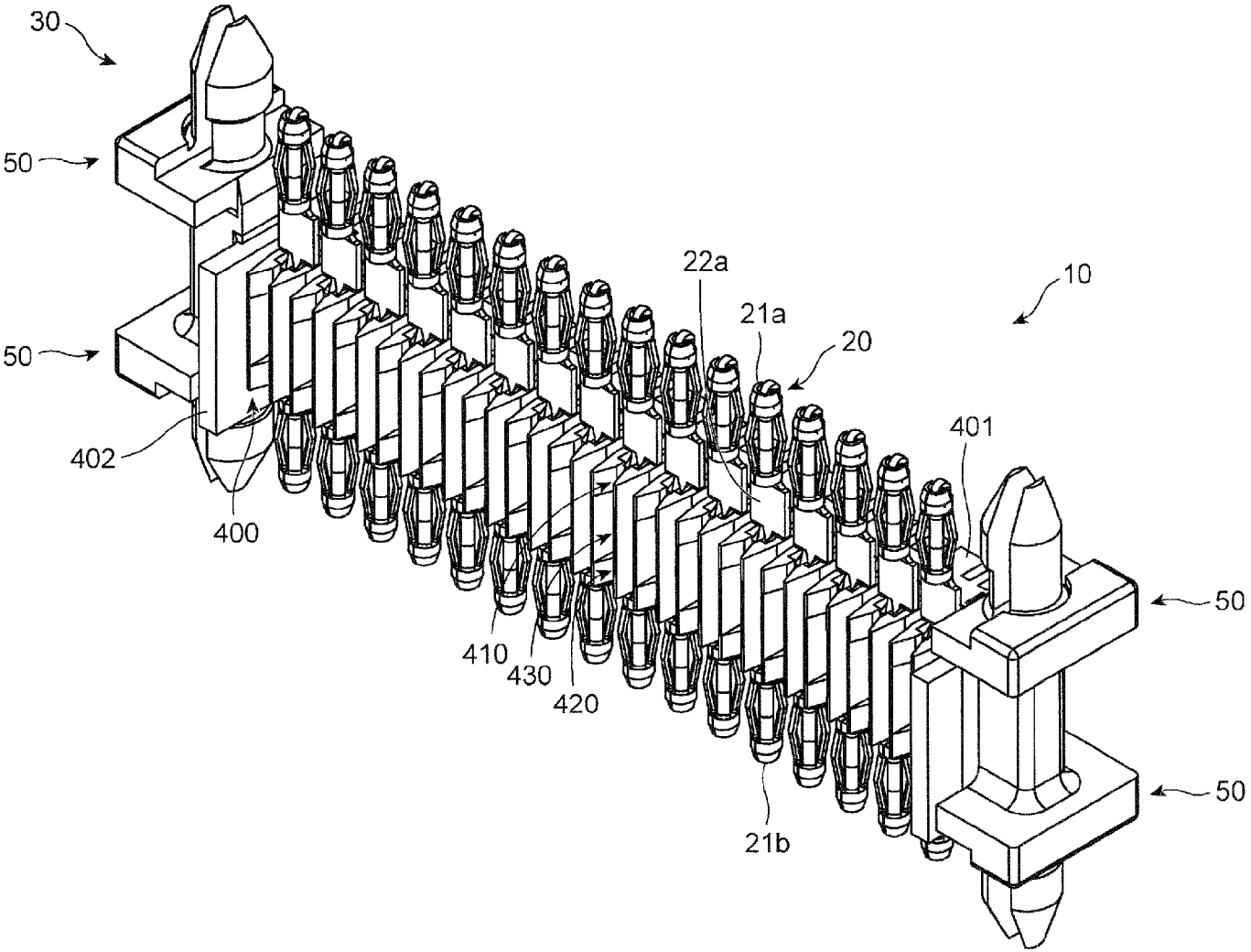
FIG. 2 is an upper perspective view of the printed circuit boards, the connector terminals, and the connector housing all illustrated in FIG. 1.
Figure 3:
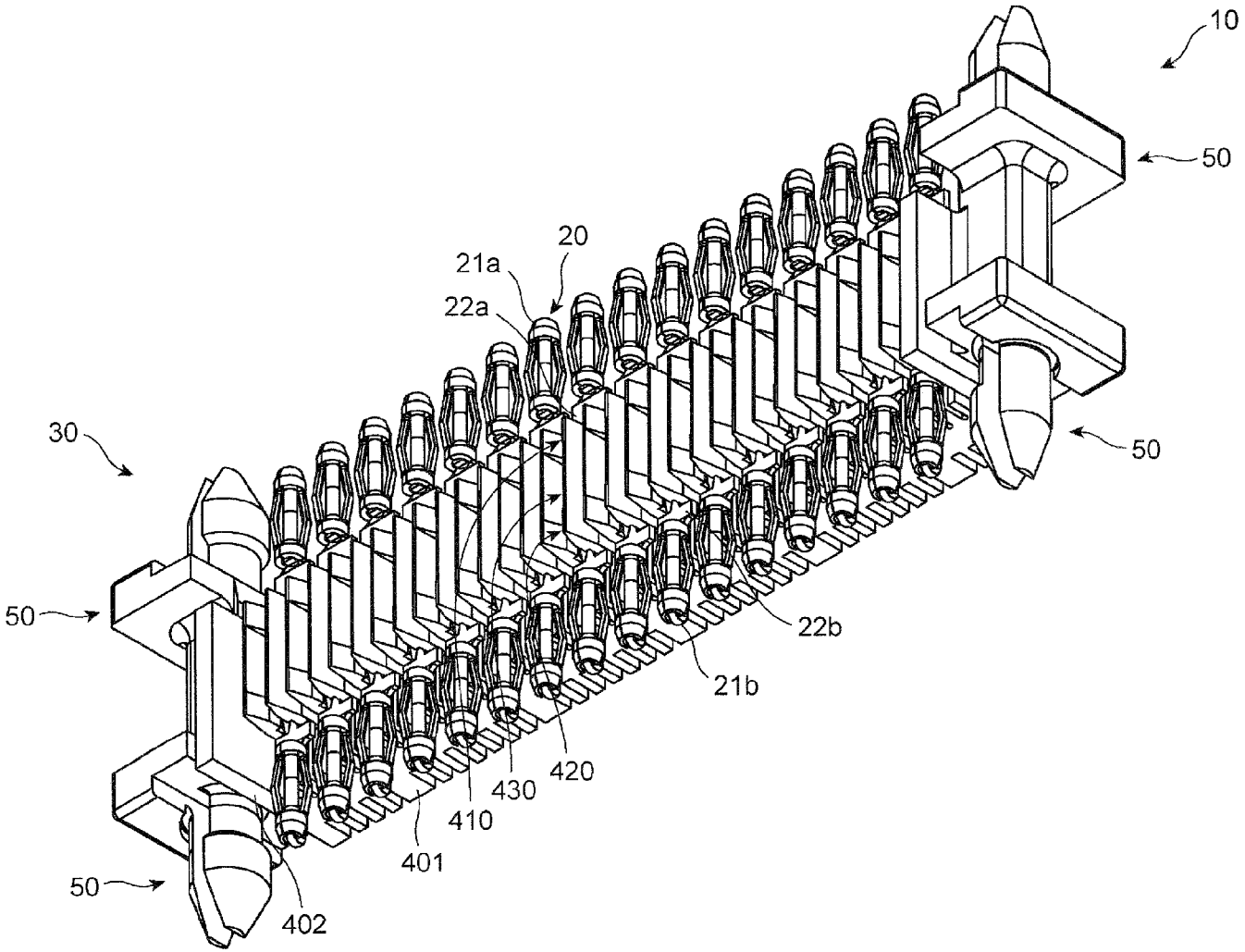
FIG. 3 is a lower perspective view of the printed circuit boards, the connector terminals, and the connector housing all illustrated in FIG. 1.

FIGS. 1 to 3 illustrate an electric connector 10 equipped in an automobile, and used for electrically connecting printed circuit boards P1 and P2 to each other. The printed circuit boards P1 and P2 are arranged facing each other in parallel.

The electric connector 10 includes a plurality of connector terminals 20 electrically connected to the printed circuit boards P1 and P2, and a connector housing 30 supporting the connector terminals 20 in a line. Each of the connector terminals 20 is in the form substantially of a bar. The connector housing 30 includes the leg unit 50 in accordance with the first embodiment.

Figure 4:
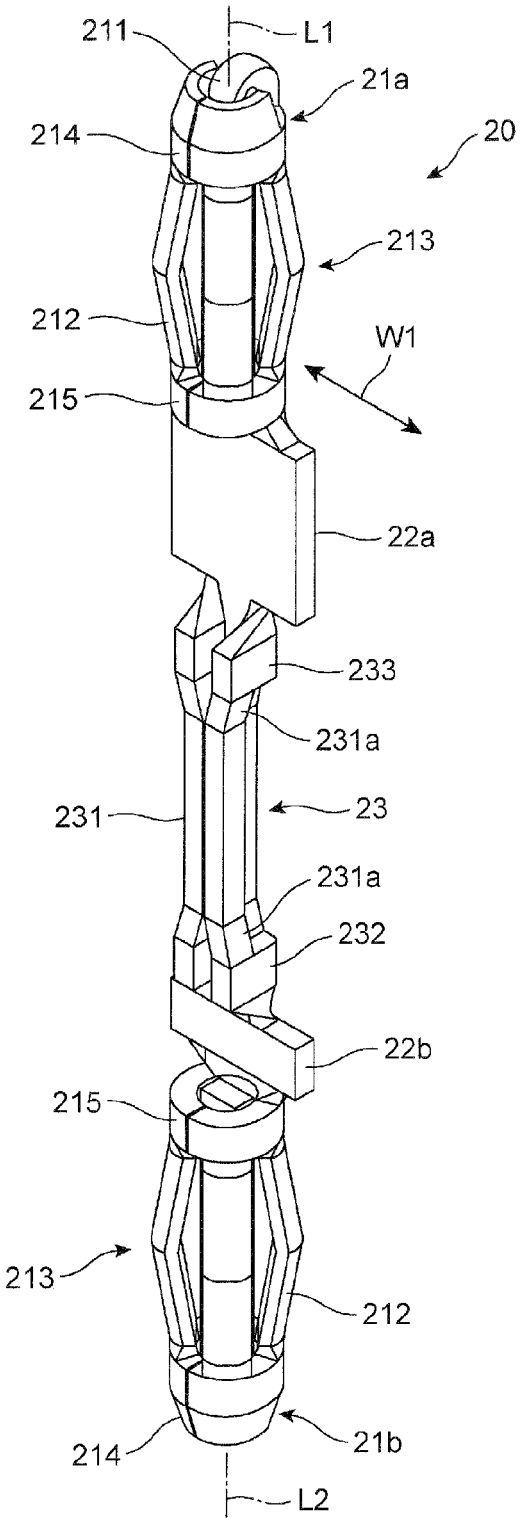
FIG. 4 is a perspective view of the connector terminal illustrated in FIG. 1.

Each of the connector terminals 20 illustrated in FIG. 4 includes first and second press-fit terminals 21*a* and 21*b* at opposite ends, first and second projecting portions 22*a* and 22*b* restricting the connector terminal 20 in the movement in a length-wise direction of the connector terminal 20, and a buffer portion 23 deformable in accordance with deflection between an imaginary longitudinal center line L1 of the first press-fit terminal 21*a* and an imaginary longitudinal center line L2 of the second press-fit terminal 21*b*. The connector terminal 20 is inserted through the first and second press-fit terminals 21*a* and 21*b* into a through-hole TH (see FIG. 1) formed through printed circuit boards P1 and P2 (see FIG. 1).

Figure 5:
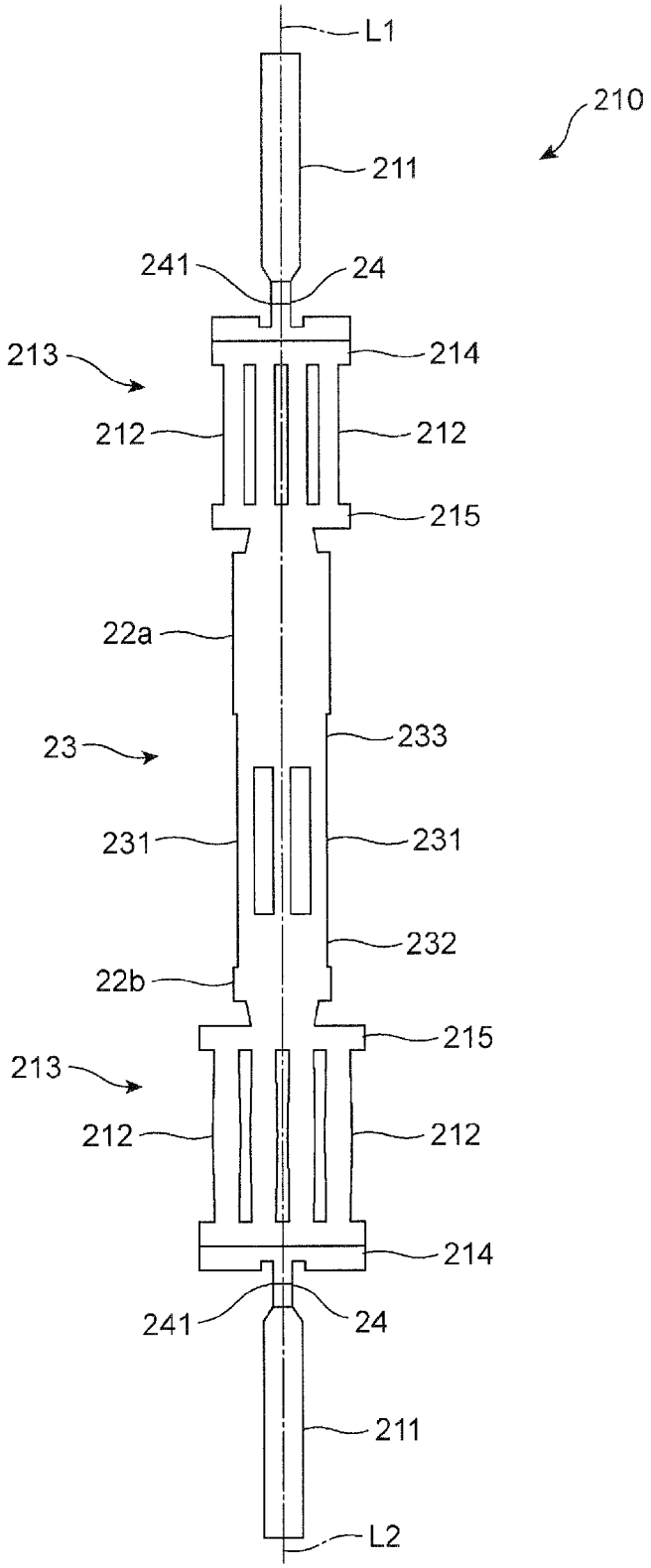
FIG. 5 is a plan view of a metal sheet from which the connector terminal illustrated in FIG. 4 is fabricated.

The connector terminal 20 can be manufactured by bending a single elastic metal plate 210 illustrated in FIG. 5.

Each of the first and second press-fit terminals 21*a* and 21*b* can be connected to the printed circuit boards P1 and P2 without being soldered. As illustrated in FIG. 4, each of the first and second press-fit terminals 21*a* and 21*b* includes a central shaft portion 211 extending in parallel with the imaginary center lines L1 and L2, respectively, and a contact portion 213 having a plurality of V-shaped contact pieces 212, and binders 214 and 215. The contact pieces 212 are equally spaced away from one another and arranged to surround the central shaft portion 211 such that they extend in a length-wise direction of the connector terminal 20, and outwardly project. That is, the contact portion 213 is in the form of a barrel around the central shaft portion 211, and hence, is able to elastically increase and decrease a diameter thereof, because the contact pieces 212 are elastically deformable. Each of the binders 214 and 215 is C-shaped to thereby bind the contact pieces 212 at longitudinal opposite ends thereof around the central shaft portion 211.

The first and second projecting portions 22*a* and 22*b* prohibit the movement of the connector terminal 20 in a length-wise direction. As illustrated in FIG. 4, each of the first and second projecting portions 22*a* and 22*b* is located adjacent to the first and second press-fit terminals 21*a* and 21*b*, respectively, and projects beyond the first and second press-fit terminals 21*a* and 21*b* in a width-wise direction W1 of the connector terminal 20. As explained later, each of the first and second projecting portions 22*a* and 22*b* makes abutment with an outer edge of later-mentioned first and second holders 410 and 420 of the connector housing 30, respectively.

The first projecting portion 22*a* located closer to the printed circuit board P1 (see FIG. 1) is designed longer in a length-wise direction of the connector terminal 20 than the second projecting portion 22*b* located closer to the printed circuit board P2, and is equal in length to the second projecting portion 22*b* in the width-wise W1 direction of the connector terminal 20.

Since the first and second projecting portions 22*a* and 22*b* are formed of an elastic thin metal plate, they can accomplish the same performance as that of the buffer portion 23.

As illustrated in FIG. 4, the buffer portion 23 is located at a center of the connector terminal 20 between the first and second press-fit terminals 21*a* and 21*b*. The buffer portion 23 includes a plurality of elastic pieces 231, and binders 232 and 233 located at opposite ends of the elastic pieces 231. The elastic pieces 231 are equal in width to one another, equally spaced away from one another, and arranged in parallel with one another. The binders 232 and 233 are bent in the form of U-shape such that they surround the longitudinal center line of the connector terminal 20. Since the elastic pieces 231 are bound such that the elastic pieces 231 are located at opposite ends 231*a* thereof in the vicinity of the longitudinal center line of the connector terminal 20, the elastic pieces 231 extend along and in parallel with the longitudinal center line of the connector terminal 20.

In the first embodiment, the three elastic pieces 231 are connected to the binders 232 and 233 such that the elastic pieces 231 are bound to be located close to one another. Hence, each of the three elastic pieces 231 makes uniform contact with each of three inner walls of the U-shaped binders 232 and 233.

For instance, in the case that the buffer portion 23 includes four or five elastic pieces 231, the binders 232 and 233 may be designed to have a rectangular or pentagonal cross-section, respectively. As an alternative, the binders 232 and 233 may be designed to be C-shaped or arcuate, even in which case, it is preferable that the elastic pieces 231 are bound such that they are located at the opposite ends 231*a* thereof close to the longitudinal center line of the connector terminal 20, and extend in parallel with the longitudinal center line of the connector terminal 20.

Hereinbelow is explained a process of manufacturing the connector terminal 20, with reference to FIG. 5.

The connector terminal 20 is manufactured by bending a single elastic thin metal plate 210 illustrated in FIG. 5. The metal plate 210 is formed by punching a metal plate sheet into the illustrated shape.

First, each of the central shaft portions 211 located at the opposite ends of the metal plate 210 is bent about the longitudinal center lines L1 and L2 so as to have a U-shaped cross-section. Then, the U-shaped central shaft portion 211 is bent by 180 degrees towards the contact portion 213 about a line 241 horizontally extending between the central shaft portion 211 and the contact portion 213.

Then, the binders 214 and 215 extending in a direction perpendicular to the imaginary longitudinal center lines L1 and L2 and defining outer edges of the contact portion 213 are bent into C-shape, and the contact pieces 212 extending in parallel with the imaginary longitudinal center lines L1 and L2 are bent into a barrel shape such that the resultant contact portion 213 surrounds the central shaft portion 211.

After a folding line is formed into the opposite ends 231*a* with central areas of the elastic pieces 231 being kept straight, the binders 232 and 233 extending in a direction perpendicular to the imaginary longitudinal center lines L1 and L2 and defining outer edges of the buffer portion 23 are bent into U-shape to thereby bind therewith the elastic pieces 231 extending in parallel with the imaginary longitudinal center lines L1 and L2.

Thus, there is completed the connector terminal 20 illustrated in FIG. 4.

As illustrated in FIG. 5, the metal sheet portions defining the elastic pieces 213 are equal in width to one another, equally spaced away from one another, and in parallel with one another, and, as illustrated in FIG. 4, the elastic pieces 231 are bound at the opposite ends 231*a* thereof by the bent binders 232 and 233 in the vicinity of the imaginary longitudinal center lines L1 and L2. Thus, the elastic pieces 231 can be arranged in parallel with and in the vicinity of the imaginary longitudinal center lines L1 and L2 without being bent.

As illustrated in FIGS. 6 to 10, the connector housing 30 is formed by a resin injection process, and is substantially H-shaped. The connector housing 30 includes a main body 40 on which the connector terminals 20 are supported in a line, and a pair of leg units 50 at each of opposite ends of the main body 40.

The main body 40 includes a terminal housing 400 in which the connector terminals 20 are housed, a base 401, and a pair of reinforcement walls 402 formed at opposite ends of the base 401 in a length-wise direction. The terminal housing 400 is formed at a side of the base 401.

The terminal housing 400 includes a plurality of first holders 410, a plurality of second holders 420, and a plurality of guide walls 430. Each of the guide walls 430 is located between each of the first holders 410 and each of the second holders 420. The first holders 410 are equally spaced away from adjacent ones, arranged in a line, and are elastically deformable in accordance with a deflection of the connector terminal 20. Similarly, the second holders 420 are equally spaced away from adjacent ones, arranged in a line, and are elastically deformable in accordance with a deflection of the connector terminal 20. The number of the first holders 410 and the number of the second holders 420 are equal to the number of the connector terminals 20. The first holders 410 are located nearer to the printed circuit board P1 than the second holders 420, and the second holders 420 are located nearer to the printed circuit board P2 than the first holders 410. The buffer portion 23 in each of the connector terminals 20 is sandwiched between the adjacent guide walls 430.

Figure 11:
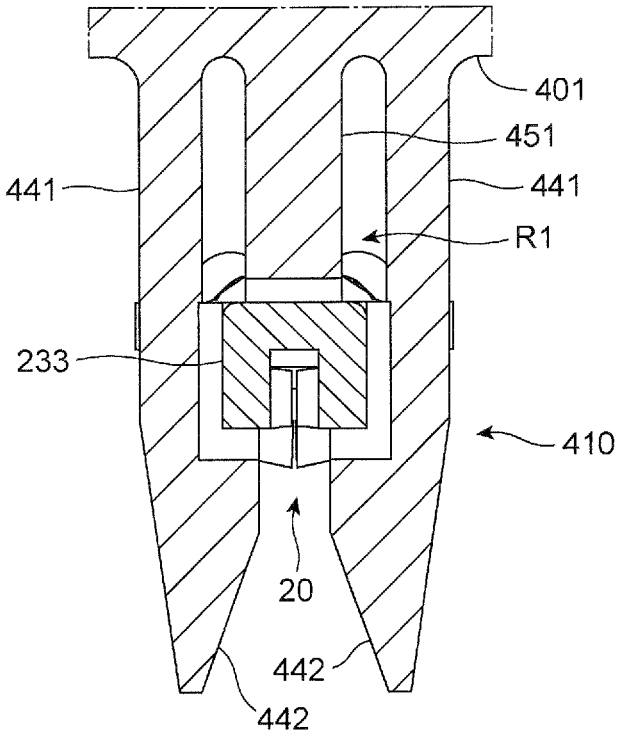
FIG. 11 is a cross-sectional view of the first holder of the connector housing.

As illustrated in FIG. 11, each of the first holders 410 includes a pair of arms 441 spaced away from each other and extending from the base 401 in parallel with each other, a pair of wedges 442 each formed at a distal end of the arm 441, and a first projection 451 extending from the base 401 between the arms 441 in parallel with the arms 441. The arms 441 and the wedges 442 are made of elastic material, and hence, are elastically deformable.

The wedges 442 inwardly project beyond the arms 441 towards each other. Between the arms 441 is formed a substantially rectangular space R in which the connector terminal 20 is housed. As illustrated in FIG. 11, the first projection 451 is designed to have such a length that the first projection 451 does not make contact at a top thereof with the connector terminal 20 inserted into the space R.

As illustrated in FIG. 11, when the connector terminal 20 is inserted into the space R, the binder 233 of the buffer portion 23 does not make contact with the first projection 451, the arms 441 and the wedges 442.

Figure 12:
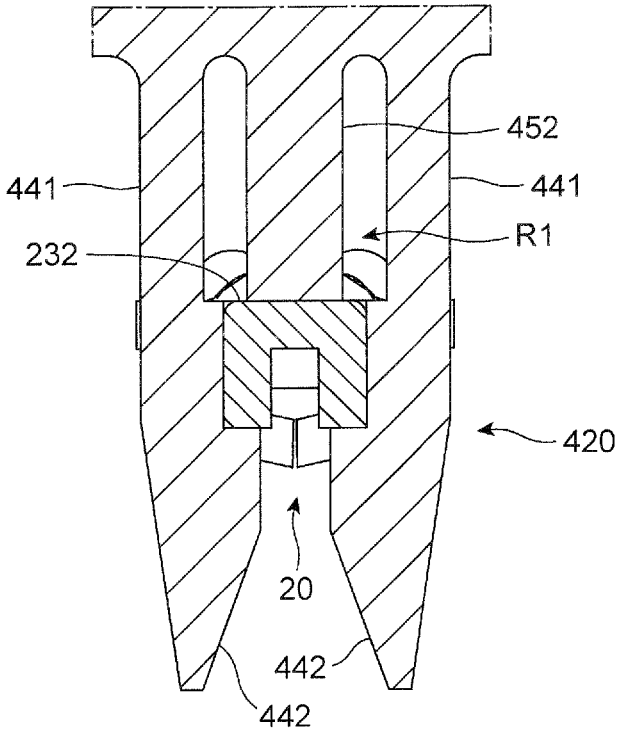
FIG. 12 is a cross-sectional view of the second holder of the connector housing.
Figure 13:
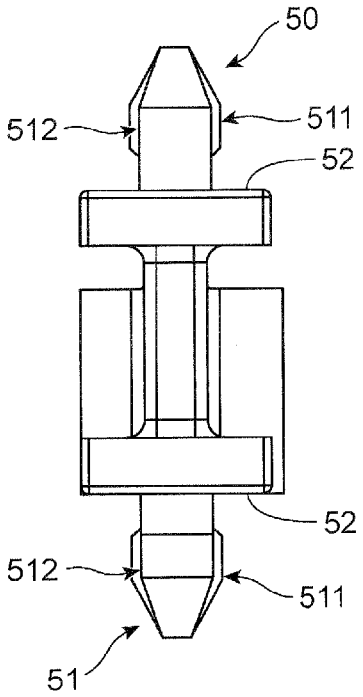
FIG. 13 is a side view of the connector housing illustrated in FIG. 6.
Figure 14:
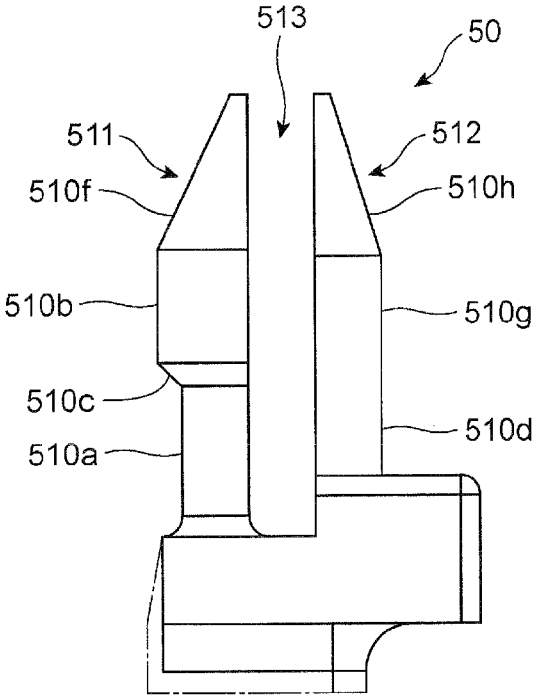
FIG. 14 is a front view of the leg unit in accordance with the first embodiment of the present invention.

As is obvious in view of comparison of FIG. 11 with FIG. 12, each of the second holders 420 is designed to have almost the same structure as that of the first holder 410 except that the arms 441, the wedges 442 and a second projection 452 are designed to make contact with the binder 232 of the buffer portion 23, when the connector terminal 20 is inserted into the space R.

As illustrated in FIG. 11, each of the first holders 410 holds the first press-fit terminal 21*a* in a non-fixed condition. Specifically, a distance between the arms 441 in the first holder 410 is set to such a distance that the arms 441 do not make contact with the connector terminal 20 when the connector terminal 20 is inserted into the space R, and the first projection 451 is designed to have such a length that the first projection 451 does not make contact with the connector terminal 20 when the connector terminal 20 is inserted into the space R.

In contrast, as illustrated in FIG. 12, each of the second holders 420 holds the second press-fit terminal 21*b* in a fixed condition. Specifically, a distance between the arms 441 in the second holder 420 is set to such a distance that the arms 441 make contact with the connector terminal 20 when the connector terminal 20 is inserted into the space R, and the second projection 452 in the second holder 420 is designed to have such a length that the second projection 452 makes contact with the connector terminal 20 when the connector terminal 20 is inserted into the space R.

Figure 6:
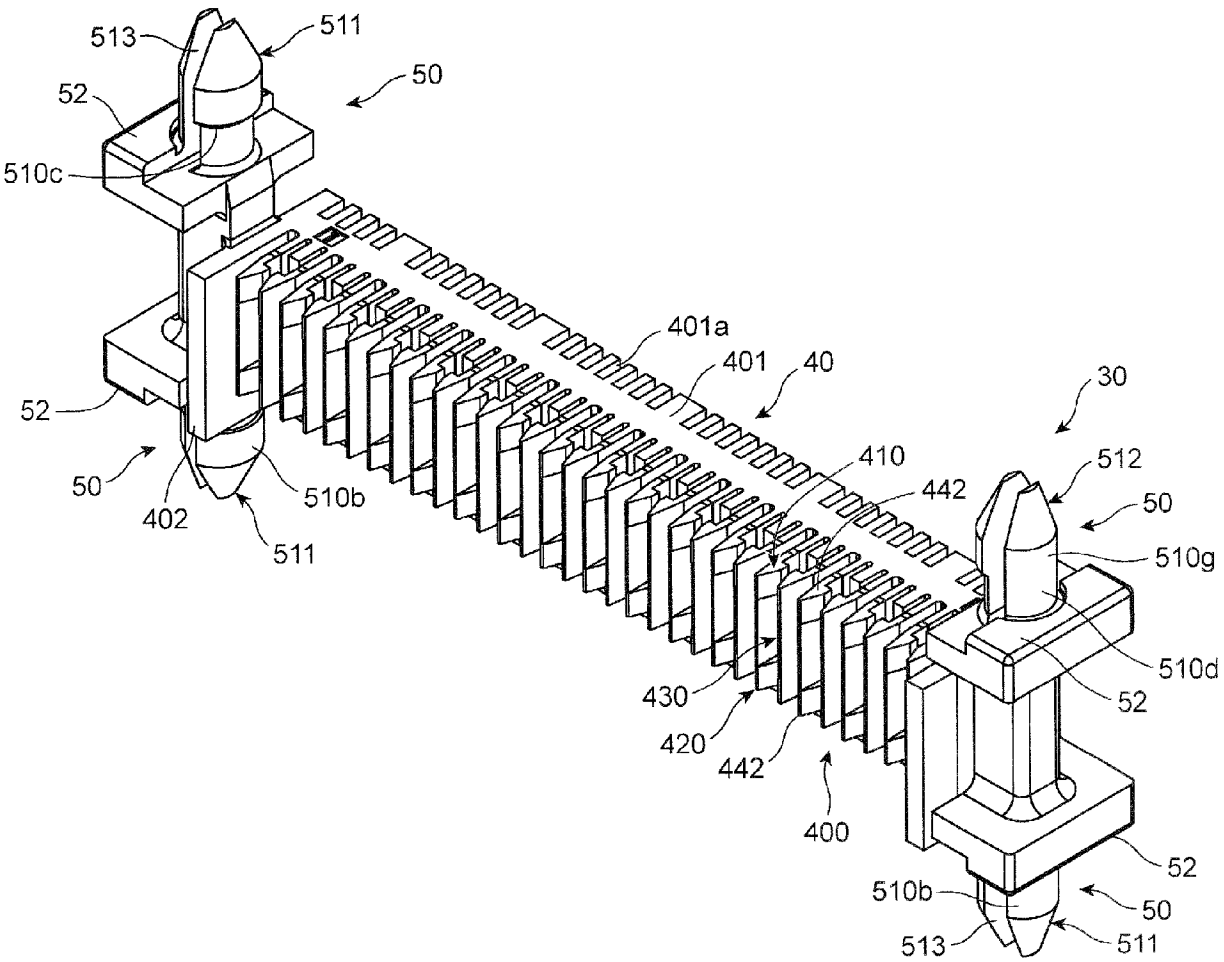
FIG. 6 is an upper perspective view of the connector housing illustrated in FIG. 1.
Figure 7:
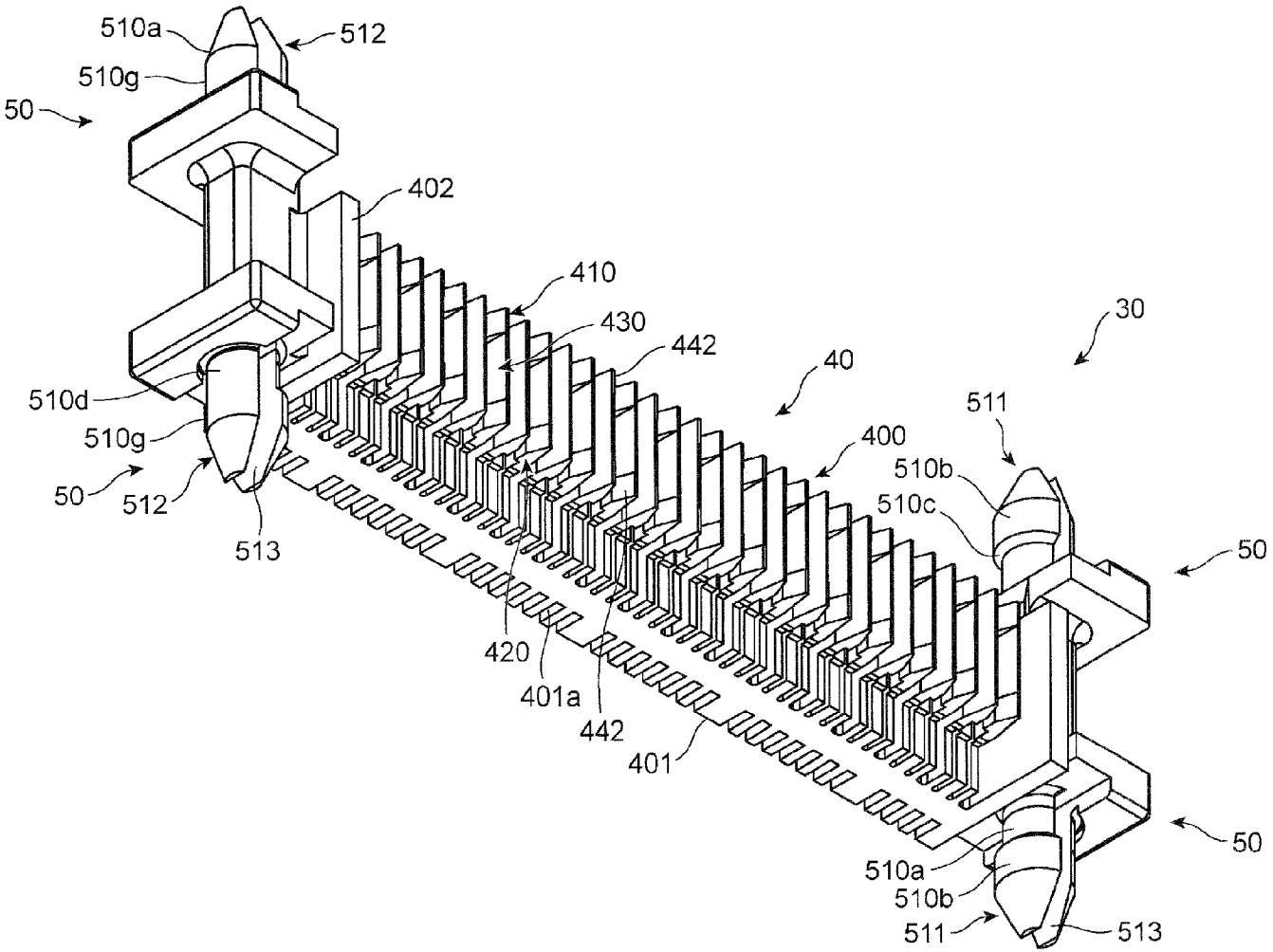
FIG. 7 is a lower perspective view of the connector housing illustrated in FIG. 1.
Figure 8:
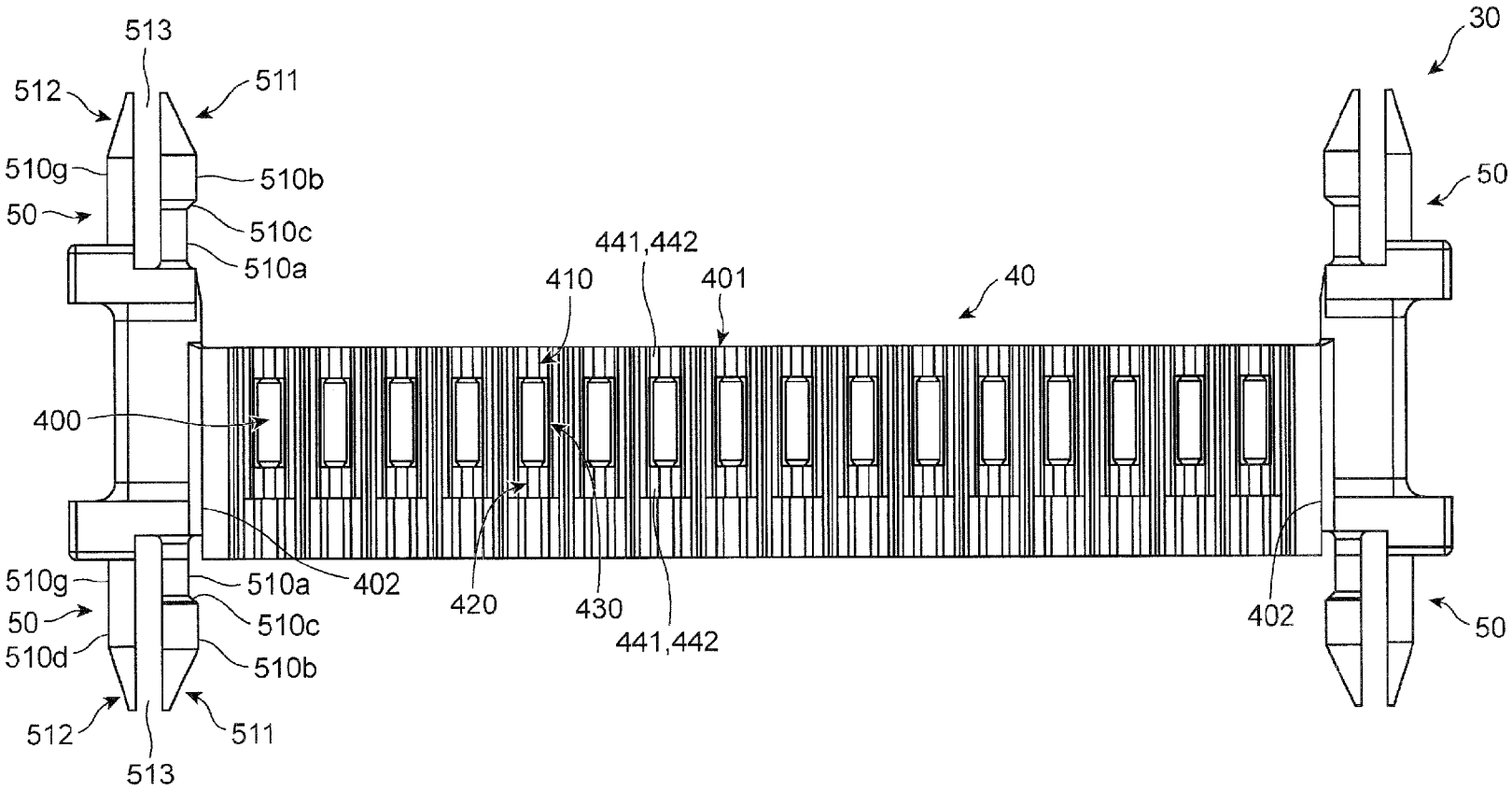
FIG. 8 is a front view of the connector housing illustrated in FIG. 1.
Figure 9:
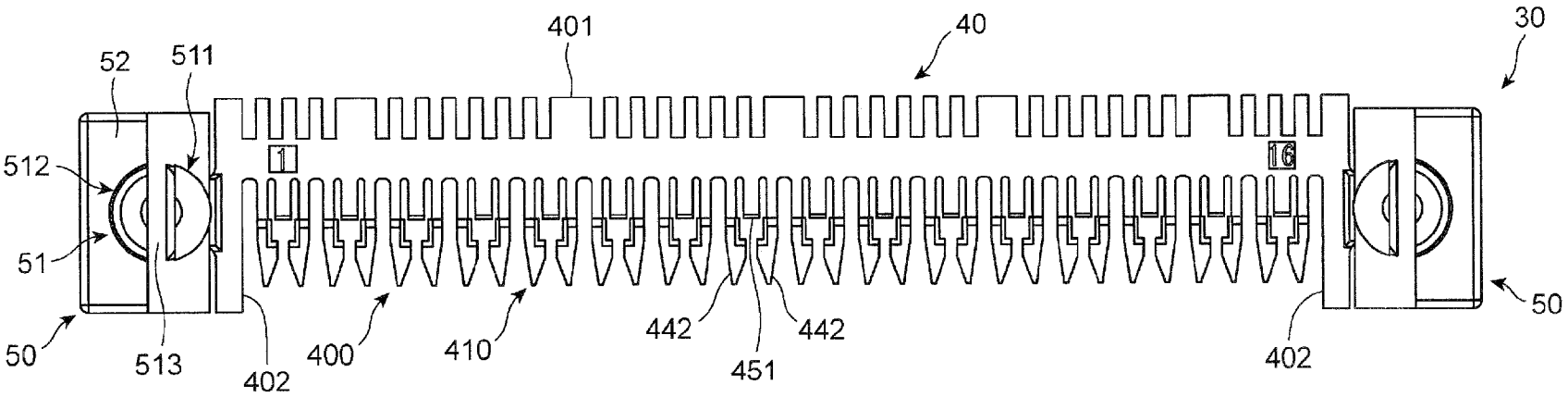
FIG. 9 is a plan view of the connector housing illustrated in FIG. 1.
Figure 10:
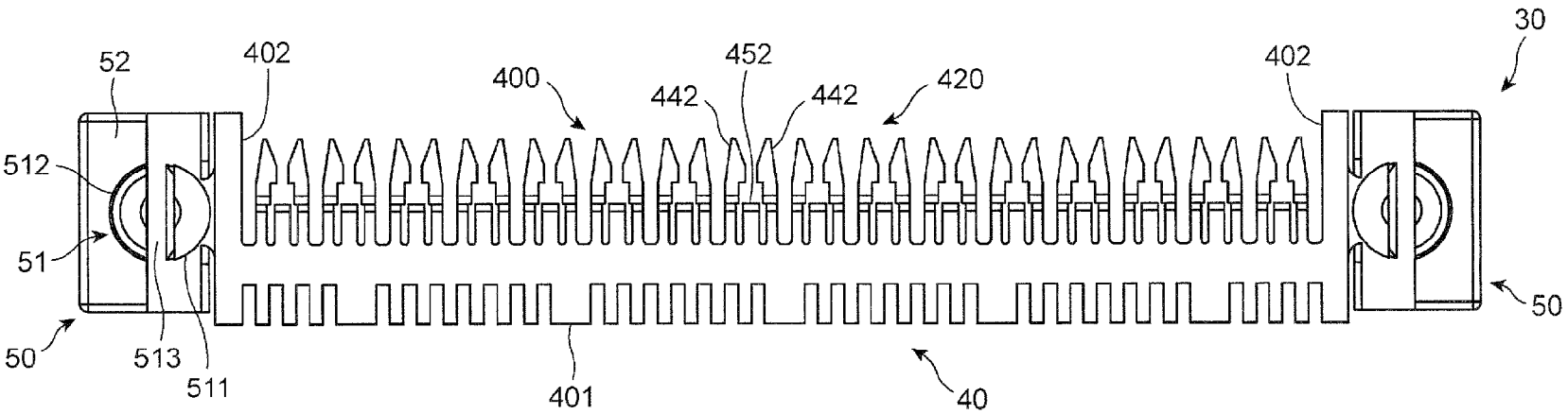
FIG. 10 is a bottom view of the connector housing illustrated in FIG. 1.

As illustrated in FIGS. 6 to 8, each of the guide walls 430 is formed continuously and integrally between the first holder 410 and the second holder 420.

The base 401 is rectangular in shape. The base 401 is formed at one side thereof with the connector housing 400 and at the other side thereof with grooves 401*a* at a predetermined pitch. The grooves 401*a* extend in parallel with a longitudinal axis of the connector terminal 20 housed in the terminal housing 400. The grooves 401*a* formed at a predetermined pitch on the base 401 provide enhanced flexibility to the base 401 in a length-wise direction. Furthermore, since partition walls between which the grooves 401*a* are formed act as ribs, rigidity of the base 401 is enhanced in a direction perpendicular to a length-wise direction of the base 401.

Each of the reinforcement walls 402 projects forwardly beyond the base 401 at the opposite ends of the base 401. The reinforcement walls 402 provide enhanced rigidity to the base 401 in a direction perpendicular to a length-wise direction of the base 401.

As illustrated in FIGS. 1 and 13 to 16, the leg unit 50 in accordance with the first embodiment is inserted into the fixing hole Pb of the printed circuit boards P1 and P2 from a first surface Pa towards a second surface Pe of the printed circuit boards P1 and P2.

The leg unit 50 includes a first projection 511 having elasticity, a second projection 512, and a contact portion 52 making contact with the first surface Pa when the leg unit 50 is inserted into the fixing hole Pb.

The first projection 511 includes a first shaft portion 510*a* having a semicircular cross-section, a second shaft portion 510*b* formed continuous with the first shaft portion 510*a*, having a semicircular cross-section, and having a radius greater than the same of the first shaft portion 510*a*, an inclined portion 510*c* formed between the first shaft portion 510*a* and the second shaft portion 510*b*, and a third shaft portion 510*f* formed continuous with the second shaft portion 510*b*, having a semicircular cross-section, and being tapered.

The second projection 512 includes a first shaft portion 510*g* having a semicircular cross-section, and a second shaft portion 510*h* formed continuous with the first shaft portion 510*g*, having a semicircular cross-section, and being tapered.

When the leg unit 50 is inserted into the fixing hole Pb, the first shaft portion 510*g* of the second projection 512 makes contact with an inner surface of the fixing hole Pb to thereby position the leg unit 50 relative to the printed circuit boards P1 and P2.

As later mentioned, when the leg unit 50 is inserted into the fixing hole Pb, the first shaft portions 510*a* and 510*g* make contact with an inner surface of the fixing hole Pb.

The first projection 511 and the second projection 512 are spaced away from each other with a gap 513 being formed therebetween, and are situated such that arcuate portions of them oppositely face each other. Specifically, the first and second projections 511 and 512 both having a semicircular cross-section are arranged such that their outer surfaces define a circumference of a circle.

The circle defined by the first and second projections 511 and 512 is designed to have a diameter D1 (see FIG. 15) greater in a predetermined range than an inner diameter D2 (see FIG. 15) of the fixing hole Pb.

Herein, the predetermined range is defined as such a range that the first projection 511 is kept inclined in the fixing hole Pb, and the first shaft portion 510*a* of the first projection 511 makes contact with an edge Pd of the fixing hole Pb on a level with the first surface Pa when the leg unit 50 is inserted into the fixing hole Pb.

For instance, the predetermined range is defined as a range of 0.5% to 20% of the inner diameter D2 of the fixing hole Pb.

The contact portion 52 is located adjacent to the second projection 512, and includes a contact surface 52*a* making contact with the first surface Pa of the printed circuit boards P1 and P2 when the leg unit 50 is inserted into the fixing hole Pb. The contact surface 52*a* extends perpendicularly to a length-wise direction of the second projection 512.

A distance L1 between the contact surface 52*a* of the contact portion 52 and a leading edge 510*ca* of the inclined portion 510*c* is set smaller than a thickness T of the printed circuit boards P1 and P2, and a distance L2 between the contact surface 52*a* of the contact portion 52 and a trailing edge 510*cb* of the inclined portion 510*c* is set greater than the thickness T of the printed circuit boards P1 and P2.

$$L1<T<L2$$

Figure 16:
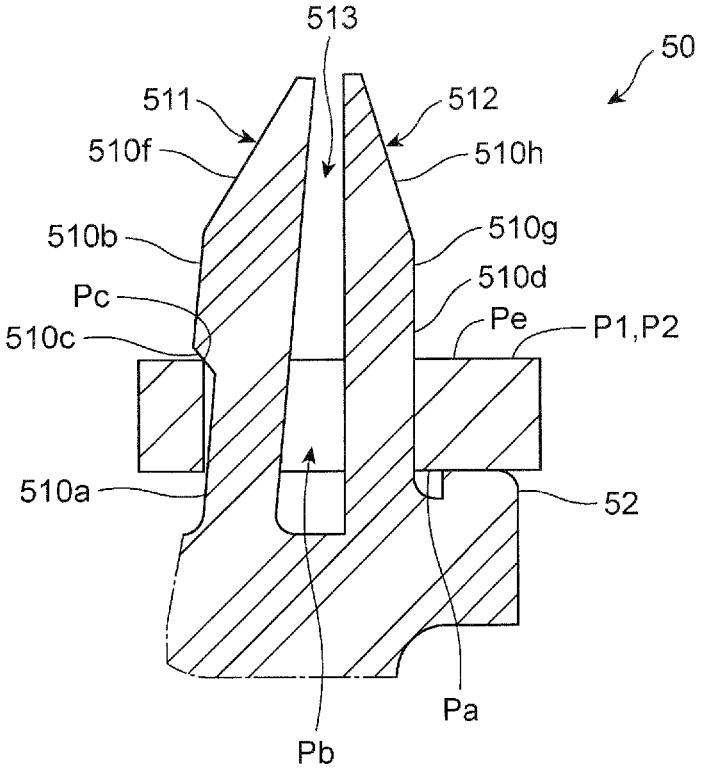
FIG. 16 is a cross-sectional view of the leg unit in accordance with the first embodiment after having been inserted into a fixing hole of a printed circuit board.

Accordingly, when the leg unit 50 is inserted into the fixing hole Pb, the inclined portion 510*c* makes contact with an edge Pc of the fixing hole Pb on a level with the second surface Pe of the printed circuit boards P1 and P2, as illustrated in FIG. 16.

Since the inclined portion 510 is engaged to the edge Pc of the fixing hole Pb on a level with the second surface Pc, the leg unit 50 cannot be pulled out of the fixing hole Pb after the leg unit 50 has been inserted into the fixing hole Pb.

With respect to the electric connector 10 having the above-mentioned structure, a process of setting the connector terminals 20 into the connector housing 30 is explained hereinbelow.

When the connector terminals 20 are set into the connector housing 30, the connector terminals 20 are brought located in front of the connector housing 30. The buffer portion 23 of each of the connector terminals 20 is aligned with the guide walls 430.

Then, each of the connector terminals 20 is inserted into the first and second holders 410 and 420. When the connector terminal 20 is inserted into the space R through the wedges 442, the arms 441 are elastically deformed to thereby outwardly expand. Thus, even if a space between the wedges 442 is shorter than a width of the binders 232 and 233 of the buffer portion 23, the connector terminal 20 can be inserted into the first and second holders 410 and 420.

Since the arms 441 and the wedges 442 in the first and second holders 410 and 420 are made of elastic material, the wedges 442 can move away from each other without acting an excessive compressive force onto the connector terminal 20, ensuring that the connector terminal 20 can be readily inserted into the first and second holders 410 and 420. Furthermore, when the arms 441 are elastically deformed to return to their initial positions, a space between the wedges 442 is shortened, and hence, the connector terminal 20 is held between the arms 441.

Then, a process of inserting the connector terminals 20 into the printed circuit boards P1 and P2 is explained hereinbelow.

First, as illustrated in FIG. 1, the first and second projections 511 and 512 of the leg unit 50 are inserted into the fixing hole Pb formed through the printed circuit board P2, and the second press-fit terminals 21*b* are inserted into the fixing holes TH formed in line through the printed circuit board P2.

Figure 15:
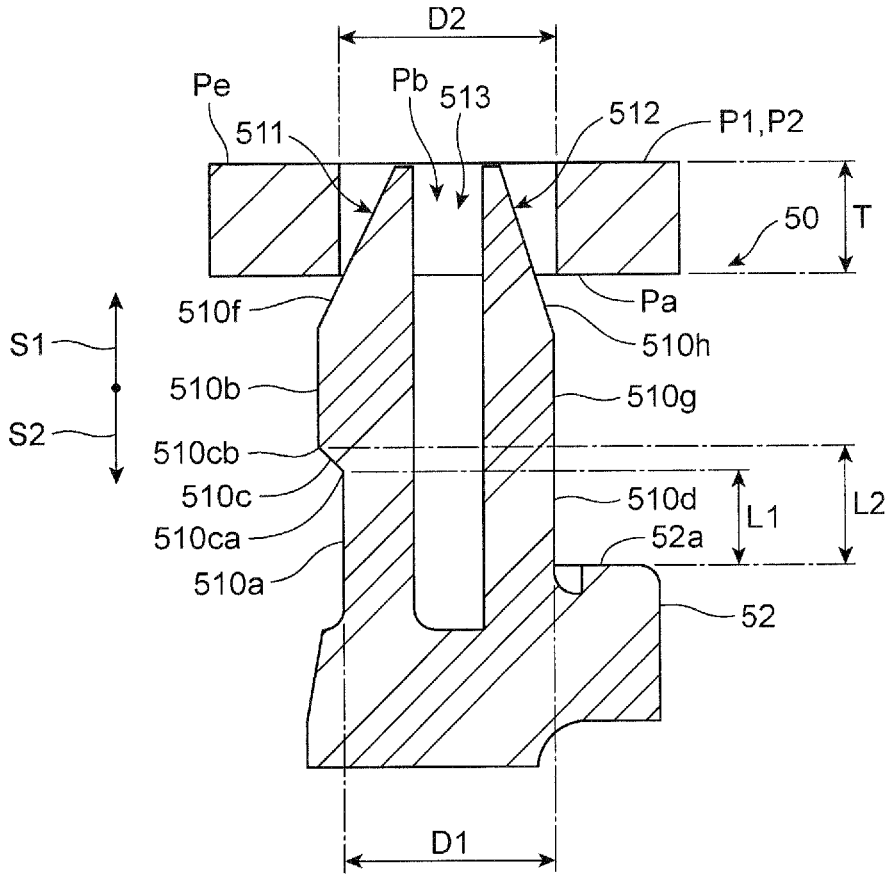
FIG. 15 is a cross-sectional view of the leg unit in accordance with the first embodiment before inserted into a fixing hole of a printed circuit board.

As illustrated in FIG. 15, inserting the first and second projections 511 and 512 of the leg unit 50 into the fixing hole Pb of the printed circuit board P2, the second projection 512 straightly forwards into the fixing hole Pb, sliding on an inner surface of the fixing hole Pb. Herein, an outer surface of the first shaft portion 510*g* acts as a guide 510*d*.

As illustrated in FIG. 16, since the first shaft portion 510*g* of the second projection 512 makes contact at an outer surface thereof with an inner surface of the fixing hole Pb, the leg unit 50 enables the connector housing 30 to follow a displacement of the printed circuit board P2 in a direction of a plane of the printed circuit board P2.

As illustrated in FIG. 15, as the second shaft portion 510*b* of the first projection 511 forwards in the fixing hole Pb, the first projection 511 is caused to be inclined towards the second projection 512. When the second shaft portion 510*b* passes over the fixing hole Pb, as illustrated in FIG. 16, the contact portion 52 makes contact at the contact surface 52*a* thereof with the first surface Pa of the printed circuit board P2 to thereby prevent the first and second projections 511 and 512 to make further movement in a direction S1. Furthermore, the inclined portion 511*c* of the first projection 511 compresses and engages to the edge Pc of the fixing hole Pb on a level with the second surface Pe of the printed circuit board P2 by virtue of elastic reaction force with the first shaft portion 510*a* being inclined towards the second projection 512 in the fixing hole Pb. As a result, the first and second projections 511 and 512 are prohibited to make movement in a direction S2.

The inclined portion 510*c* of the first projection 511 makes contact with the edge Pc of the fixing hole Pb on a level with the second surface Pe to thereby prevent the first and second projections 511 and 512 to be released out of the fixing hole Pb. Thus, the first shaft portion 510*a* of the first projection 511 is elastically deformed in response to a displacement of the first and second projections 511 and 512 relative to the printed circuit board P2 in a thickness-wise direction thereof, and the inclined portion 510*c* is kept engaged to the edge Pc of the fixing hole Pb to thereby absorb the displacement. Accordingly, it is possible to prevent looseness of the first projection 511 relative to the fixing hole Pb.

Thus, the first and second projections 511 and 512 enable the connector housing 30 to follow a displacement of the printed circuit board P2 in a thickness-wise direction.

By inserting the first and second projections 511 and 512 into the fixing hole Pb, it is possible to cause the connector housing 30 to follow a displacement of the printed circuit board P2 both in a thickness-wise direction and in a direction of a plane of the printed circuit board P2. Thus, it is possible to prevent looseness of the connector housing 30 relative to the printed circuit board P2, ensuring reduction in a load to be exerted on the connector terminals 20.

As illustrated in FIG. 12, since the second holder 420 holds the connector terminal 20 in a fixed condition, when the second press-fit terminal 21*b* is inserted into the through-hole TH of the printed circuit board P2, there is no play between the connector terminal 20 and the connector housing 30, ensuring that the connector terminal 20 is kept not moved. Thus, it is possible to simultaneously, smoothly and accurately insert a plurality of the second press-fit terminals 21*b* of the connector terminals 20 arranged in a line, into the through-holes TH of the printed circuit board P2.

Even if a stress acts on the connector terminal 20 in a direction of the longitudinal center line L2 thereof when the second press-fit terminal 21*b* is inserted into the through-holes TH, the second projection portion 22*b* is engaged with the arms 441 and the wedges 442 of the second holder 420, and hence, the connector terminal 20 can be avoided from moving towards the longitudinal center line L2. Thus, since the connector terminal 20 does not move in a direction of the longitudinal center line L2, the second press-fit terminal 21*b* can be smoothly inserted into the through-holes TH of the printed circuit board P2.

Then, after the printed circuit board P1 was positioned above the electric connector 10, the first and second projections 511 and 512 are inserted into the fixing holes Pb of the printed circuit board P1, and the first press-fit terminals 21*a* are inserted into the through-hole TH formed in a line through the printed circuit board P1.

The first and second projections 511 and 512 are inserted into the fixing hole Pb of the printed circuit board P1, similarly to the insertion of the first and second projections 511 and 512 into the printed circuit board P2. As illustrated in FIG. 15, the first projection 511 is inserted into the fixing hole Pb with the second projection 512 going forward as a guide in the fixing hole Pb. Since the inclined portion 510*c* is engaged with the upper edge Pc of the fixing hole Pb, the first and second projections 511 and 512 are prohibited to move in the direction S2, that is, are not be released out of the fixing hole Pb. Furthermore, since the contact portion 52 makes abutment at the contact surface 52*a* thereof with the first surface Pa of the printed circuit board P1, the first and second projections 511 and 512 are prohibited to move in the direction S1. Thus, the first and second projections 511 and 512 are prohibited by the contact portion 52 to move in the direction S1, and further, are prohibited by the inclined portion 510*c* to move in the direction S2, resulting in that the first and second projections 511 and 512 and accordingly the connector housing 30 are fixed to the printed circuit board P1.

Even if a positional relation between the printed circuit boards P1 and P2 were deflected when the first press-fit terminals 21*a* are inserted into the through-holes TH, since the first holder 410 holds the connector terminal 20 in a non-fixed condition, as illustrated in FIG. 11, the connector terminal 20 is able to move within the space R in the first holder 410, and hence, the first press-fit terminal 21*a* can be accurately positioned relative to the through-hole TH. Accordingly the first press-fit terminal 21*a* can be inserted into the through-holes TH without exerting much load onto the first press-fit terminal 21*a*.

For instance, if the electric connector 10 oscillates while being connected to the printed circuit boards P1 and P2, a positional relation between the printed circuit boards P1 and P2 is deflected. Since the connector terminal 20 is designed to include the buffer portion 23, even if a positional relation between the first and second press-fit terminals 21*a* and 21*b* were deflected, the buffer portion 23 would be elastically deformed to absorb the deflection in the positional relation.

Furthermore, since the arms 441 and the wedges 442 in the first and second holders 410 and 420 are made of elastic material, even if a positional relation between the printed circuit boards P1 and P2 were much deflected, the arm 441 on which a load is exerted by the connector terminal 20 is outwardly deformed to thereby allow the connector terminal 20 to be deflected.

Thus, even when a positional relation between the printed circuit boards P1 and P2 were deflected due to oscillation with the first and second press-fit terminals 21*a* and 21*b* being inserted into the through-holes TH of the printed circuit boards P1 and P2 and further with the connector housing 30 being fixed to the printed circuit boards P1 and P2, it is possible to reduce a load exerted by the connector housing 30 onto the connector terminals 20.

(Second Embodiment)

Figure 17:
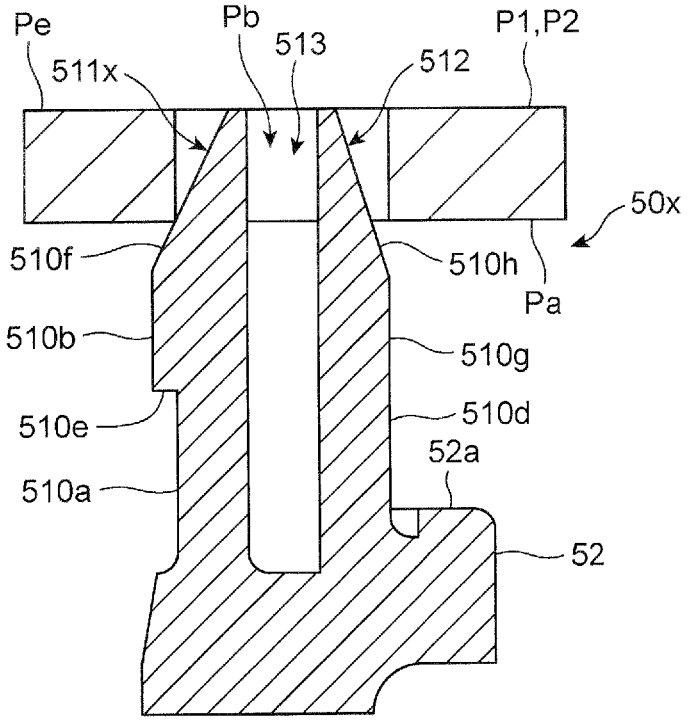
FIG. 17 is a cross-sectional view of the leg unit in accordance with the second embodiment before inserted into a fixing hole of a printed circuit board.
Figure 18:
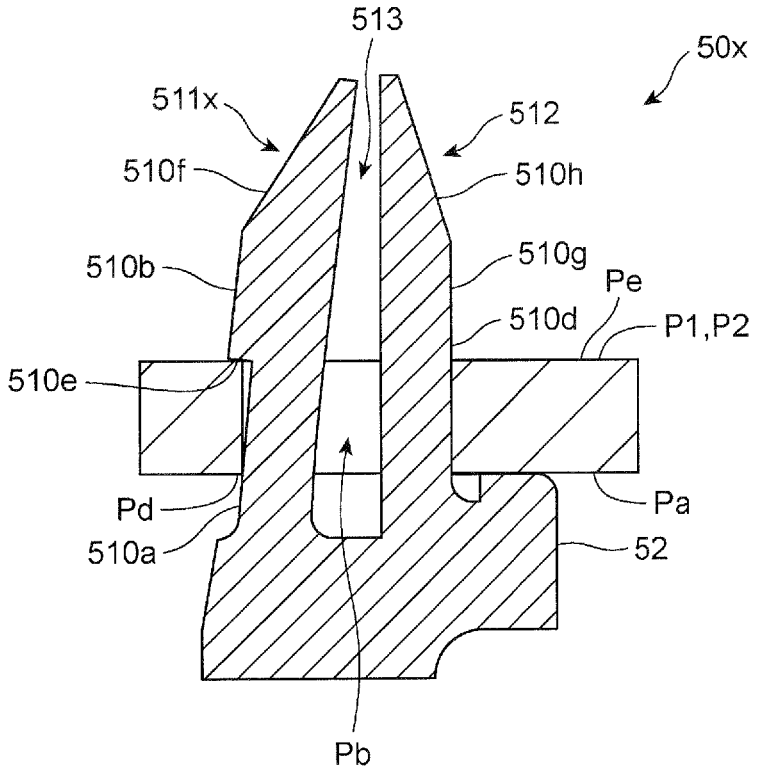
FIG. 18 is a cross-sectional view of the leg unit in accordance with the second embodiment after having been inserted into a fixing hole of a printed circuit board.
Figure 19:
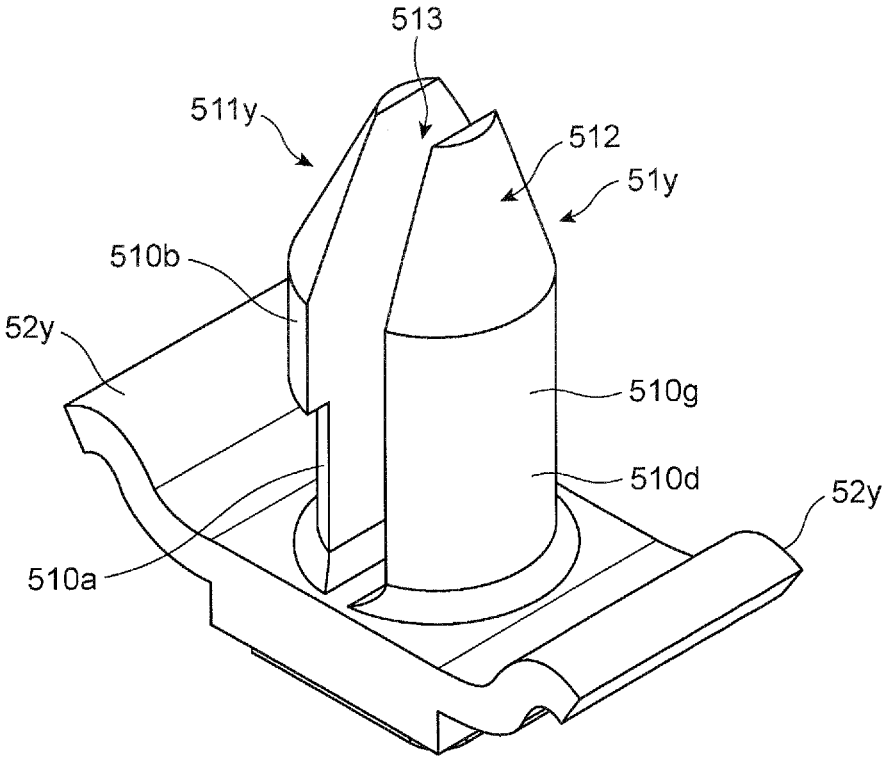
FIG. 19 is a perspective view of the leg unit in accordance with the third embodiment of the present invention.
Figure 20:
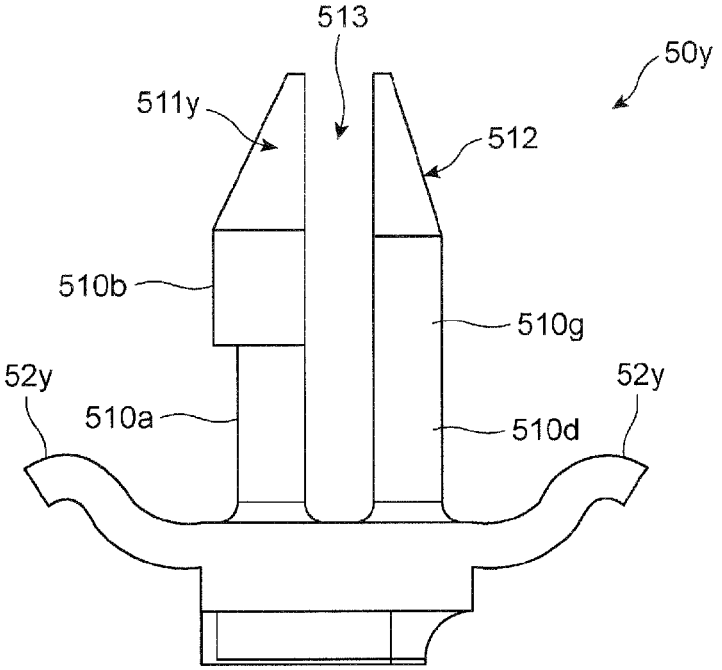
FIG. 20 is a front view of the leg unit in accordance with the third embodiment of the present invention.
Figure 21:
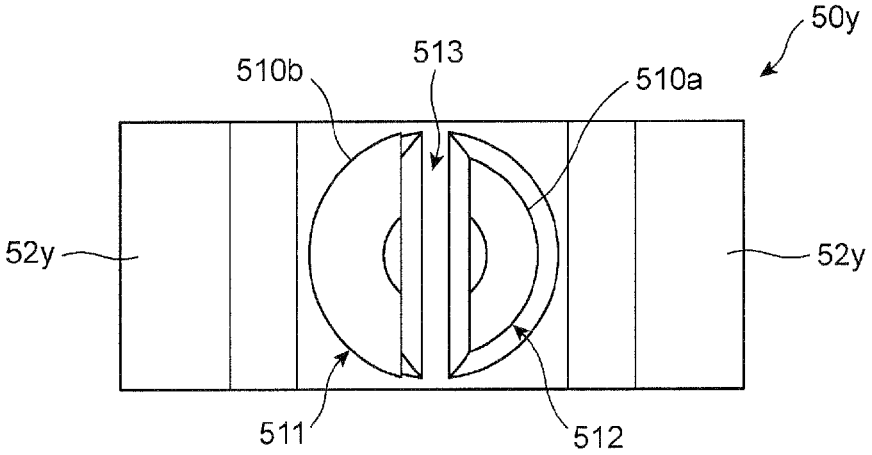
FIG. 21 is a plan view of the leg unit in accordance with the third embodiment of the present invention.
Figure 22:
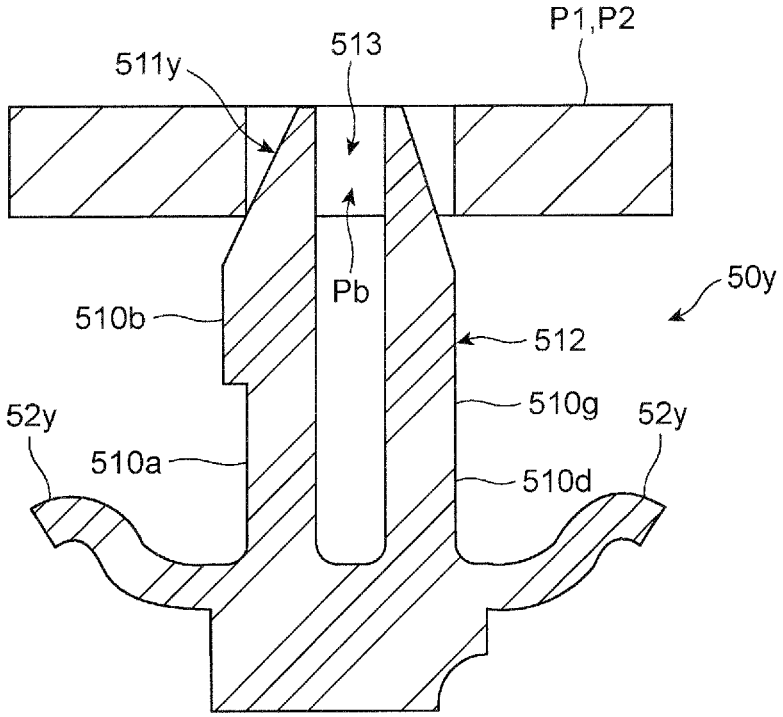
FIG. 22 is a cross-sectional view of the leg unit in accordance with the third embodiment before inserted into a fixing hole of a printed circuit board.
Figure 23:
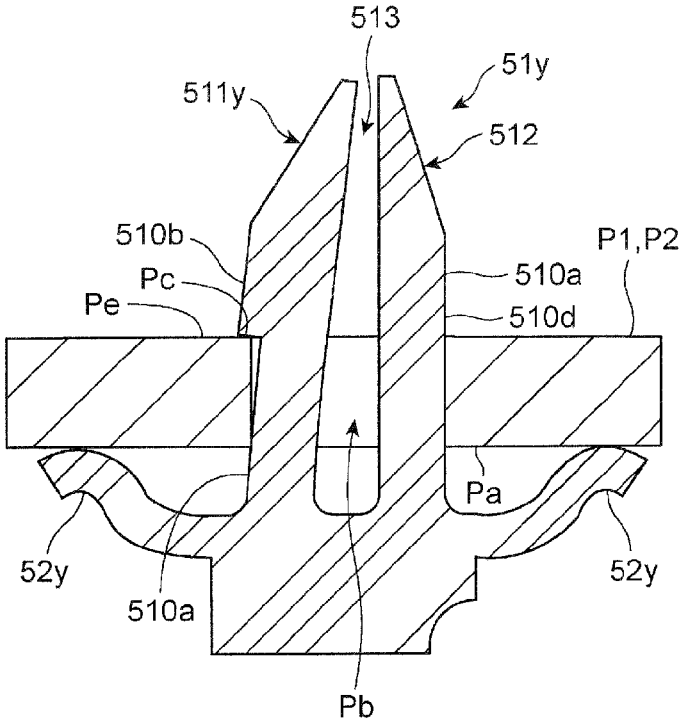
FIG. 23 is a cross-sectional view of the leg unit in accordance with the third embodiment after having been inserted into a fixing hole of a printed circuit board.

The leg unit in accordance with the second embodiment is explained hereinbelow with reference to FIGS. 17 and 18.

In comparison with the leg unit 50 in accordance with the first embodiment, the leg unit 50*x* in accordance with the second embodiment is designed to include a first projection 511*x* having a semi-annular wall 510*e* in place of the first projection 511 having the inclined portion 510*c*. The wall 510*e* extends between the first shaft portion 510*a* and the second shaft portion 510*b* perpendicularly to a length-wise direction of the first projection 511*x*.

The leg unit 50*x* in accordance with the second embodiment is designed to have the same structure as that of the leg unit 50 in accordance with the first embodiment except including the wall 510*e* in place of the inclined portion 510*c*.

After the leg unit 50*x* was inserted into the fixing hole Pb, the wall 510*e* is engaged to the second surface Pe of the printed circuit boards P1 and P2 to thereby prevent the leg unit 50*x* from moving in the direction S2, ensuring that the leg unit 50*x* is not released out of the fixing hole Pb.

The leg unit 50*x* in accordance with the second embodiment provides the same function as that of the leg unit 50 in accordance with the first embodiment. Furthermore, the wall 510*e* is engaged to the second surface Pe of the printed circuit boards P1 and P2 in a greater area than the inclined portion 510*c*. Accordingly, the leg unit 50*x* in accordance with the second embodiment can more surely prohibit the leg unit 50 to move in the direction S2, and hence, avoid the leg unit 50*x* to be released out of the fixing hole Pb than the leg unit 50 in accordance with the first embodiment.

(Third Embodiment)

The leg unit in accordance with the third embodiment is explained hereinbelow with reference to FIGS. 19 to 23.

In comparison with the leg unit 50*x* in accordance with the second embodiment, the leg unit 50*y* in accordance with the third embodiment is designed to include a pair of contact portions 52*y* in place of the contact portion 52.

The leg unit 50*y* in accordance with the third embodiment is designed to have the same structure as that of the leg unit 50*x* in accordance with the second embodiment except including the contact portions 52*y* in place of the contact portion 52.

The contact portions 52 are made of an elastic material.

The contact portions 52 extend from proximal ends of the first and second projections 511*y* and 512 in opposite directions radially of the first and second projections 511*y* and 512.

Each of the contact portions 52 is J- or U-shaped, and makes contact at a summit thereof with the first surface Pa of the printed circuit boards P1 and P2. In other words, each of the contact portions 52*y* is in the form of a spring plate, making contact with the first surface Pa at a location away from a center of the leg unit 50*y*.

The leg unit 50*y* in accordance with the third embodiment provides the same function as that of the leg unit 50*x* in accordance with the second embodiment. Furthermore, since the contact portions 52*y* compress the printed circuit boards P1 and P2 through the first surface Pa by virtue of elastic reaction force to thereby push the printed circuit boards P1 and P2 to the wall 510*e*, the printed circuit boards P1 and P2 are surely sandwiched between the contact portions 52*y* and the wall 510*e*. Thus, the contact portions 52*y* enable the connector housing 30 to follow a displacement of the printed circuit boards P1 and P2 in a thickness-wise direction.

Though the leg unit 50*y* is designed to include a pair of the contact portions 52*y*, the leg unit 50*y* may be designed to include one of the contact portions 52*y*, in which case, the contact portion 52*y* is designed to provide more intensive elastic reaction force than the same provided by each of the contact portions 52*y*. As an alternative, the leg unit 50*y* may be designed to include three or four contact portions 52*y* arranged at every 120 or 90 circumference angles around a center of the leg unit 50*y*, respectively. The leg unit 50*y* may be designed to include the contact portion 52 (see the first and second embodiments) in place of one of the contact portions 52*y*.

(Variation of First Embodiment)

The leg unit in accordance with a variation of the first embodiment is explained hereinbelow with reference to FIG. 25.

Figure 24:
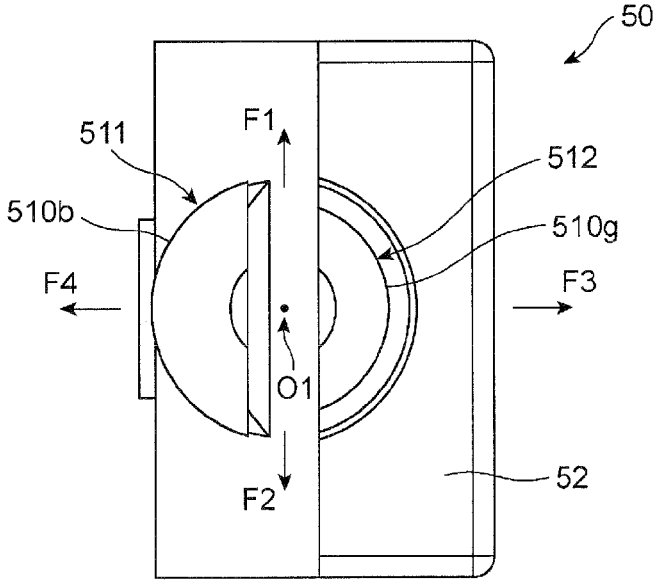
FIG. 24 is a plan view of the leg unit in accordance with the first embodiment of the present invention.

FIG. 24 is a plan view of the leg unit 50 in accordance with the first embodiment. In the leg unit 50 in accordance with the first embodiment, the first and second projections 511 and 512 define a circumference of a circle with outer surfaces thereof. Each of the first and second projections 511 and 512 is designed to have 180 degrees as a circumferential angle, as illustrated in FIG. 24.

The second projection 512 is necessary to have 180 degrees or more as a circumferential angle.

Designing the second projection 512 to have 180 degrees or more as a circumferential angle, since the first shaft portion 510*g* of the second projection 512 makes contact at an outer surface thereof with an inner surface of the fixing hole Pb, the second projection 512 is prohibited to move in directions F1 and F2, specifically, directions in which the gap 513 extends around a center O1 of the leg unit 50. Furthermore, since the first shaft portion 510*g* of the second projection 512 makes contact at an outer surface thereof with an inner surface of the fixing hole Pb, the second projection 512 is prohibited to move in a direction F3, specifically, a direction opposite to the first projection 511 about the center O1 of the leg unit 50. In addition, since the first shaft portion 510*a* of the first projection 511 makes contact at an outer surface thereof with an inner surface of the fixing hole Pb, the first projection 511 is prohibited to move in a direction F4, specifically, a direction towards the first projection 511 from the center O1 of the leg unit 50.

Thus, it is possible to prevent the second projection 512 from moving in a direction of a plane of the printed circuit boards P1 and P2, by designing the second projection 512 to have 180 degrees as a circumferential degree, ensuring that the connector housing 30 can be accurately positioned relative to the printed circuit boards P1 and P2.

Figure 25:
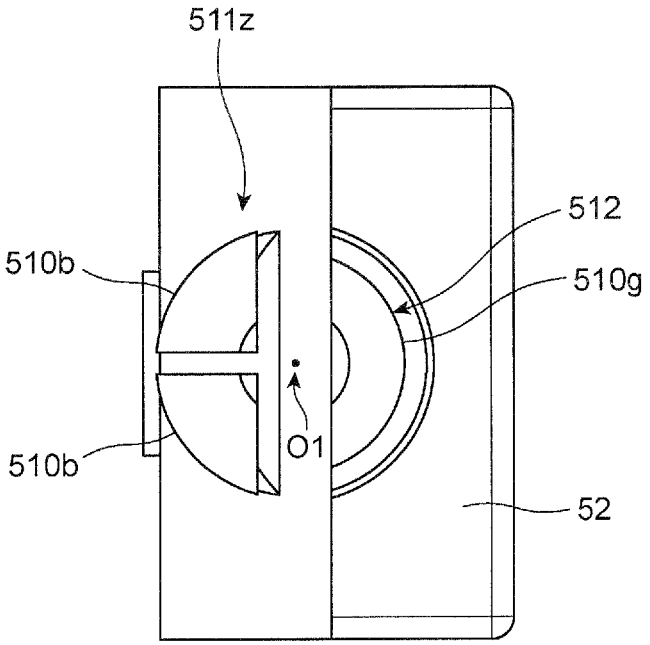
FIG. 25 is a plan view of the leg unit in accordance with a variant of the first embodiment.
Figure 26:
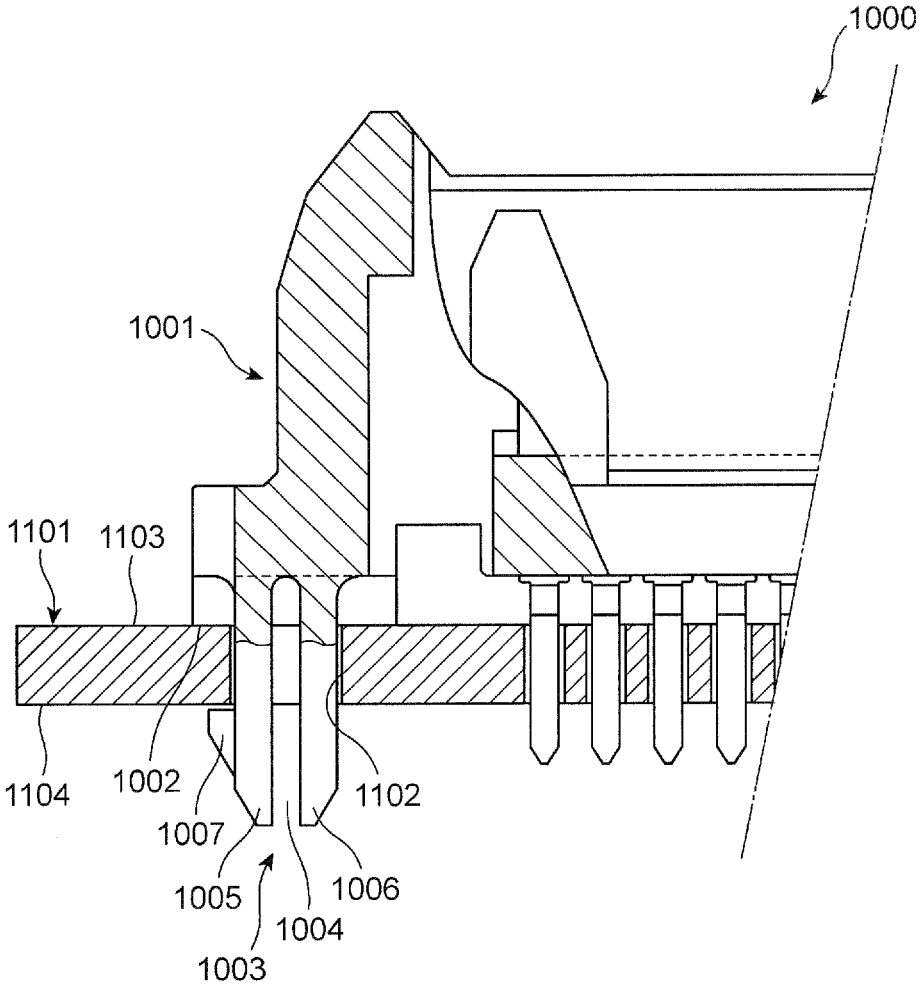
FIG. 26 is a cross-sectional view of the conventional electric connector.

If the second projection 512 is designed to have 180 degrees as a circumferential degree, the first projection 511 may be designed to have a circumferential degree smaller than 180 degrees, or the first projection 511 may be designed to be comprised of a plurality of projections 511*z*, as illustrated in FIG. 25, in which case, the projections 511*z* may have a circumferential degree equal to one another or different from one another.

INDUSTRIAL APPLICABILITY

The leg unit in accordance with the present invention is suitable to a connector housing of an electric connector used broadly in various fields such as an electric/electronic industry and an automobile industry, as an electric connector to be used for electric/electronic devices or to be equipped in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-225790 filed on Oct. 30, 2013 including specification, claims, drawings and summary is incorporated herein by reference in its entirety.

What is claimed is:

1. A leg unit used for a connector housing, said leg unit being inserted into a fixing hole formed through a printed circuit board from a first surface towards a second surface of said printed circuit board, said leg unit including:

a first projection having elasticity;

a second projection; and a contact portion making contact with said first surface when said leg unit is inserted into said fixing hole, said first and second projections being spaced away from each other and facing each other, said first projection including a structure for preventing said leg unit from being released out of said fixing hole after said leg unit has been inserted into said fixing hole, said contact portion being formed only around said second projection, said first projection including:

a first shaft portion having an arcuate outer surface;

a second shaft portion outwardly extending relative to said first shaft portion, and having an arcuate outer surface; and one of a wall and an inclined portion, said second projection having an arcuate outer surface, a distance between said arcuate outer surface of said first shaft portion of said first projection and said arcuate outer surface of said second projection being greater within a predetermined range than an inner diameter of said fixing hole, said wall extending perpendicularly to a length-wise direction of said first projection, said wall or said inclined portion being formed between said first and second shaft portions, said wall or said inclined portion making contact with said second surface when said leg unit is inserted into said fixing hole, said wall or said inclined portion defining said structure for preventing said leg unit from being released out of said fixing hole after said leg unit has been inserted into said fixing hole, said first projection and said second projection being disposed along a line along which a plurality of connector terminals are arranged and further disposed at each of opposite ends of said line such that said arcuate outer surface of said second shaft portion of said first projection disposed at one of said ends faces said arcuate outer surface of said second shaft portion of said first projection disposed at the other end of said ends, or said arcuate outer surface of said second projection disposed at one of said ends faces said arcuate outer surface of said second projection disposed at the other end of said ends.

2. The leg unit as set forth in claim 1, wherein said predetermined range is defined as such a range that said first projection is kept inclined in said fixing hole, and said first projection makes contact with an edge of said fixing hole on a level with said first surface when said leg unit is inserted into said fixing hole.

3. The leg unit as set forth in claim 1, wherein said predetermined range is defined as a range of 0.5% to 20% of the inner diameter of said fixing hole.

4. The leg unit as set forth in claim 1, wherein said contact portion includes a surface making contact with said first surface when said leg unit is inserted into said fixing hole.

5. The leg unit as set forth in claim 1, wherein said contact portion has elasticity.

6. The leg unit as set forth in claim 1, wherein each of said first and second projections has a semicircular cross-section, said first and second projections being arranged such that they define a circle.

7. The leg unit as set forth in claim 1, wherein said second projection has an arcuate cross-section having a circumference angle equal to or greater than 180 degrees.

8. The leg unit as set forth in claim 1, wherein said first projection is comprised of a plurality of projections having the same configuration as one another.

9. A connector housing used for an electric connector, said housing including at least one leg unit defined in claim 1.

* * * * *